United States Patent [19]

Dinulescu

[11] 4,442,886

[45] Apr. 17, 1984

[54] FLOATING PLATE HEAT EXCHANGER

[75] Inventor: Horia A. Dinulescu, Minneapolis, Minn.

[73] Assignee: North Atlantic Technologies, Inc., Bloomington, Minn.

[21] Appl. No.: 480,391

[22] Filed: Apr. 6, 1983

Related U.S. Application Data

[63] Continuation-in-part of Ser. No. 369,279, Apr. 19, 1982.

[51] Int. Cl.[3] ..... F28F 3/10

[52] U.S. Cl. ..... 165/76; 165/166

[58] Field of Search ..... 165/76, 78, 157, 158, 165/165, 166, 167

[56] References Cited

U.S. PATENT DOCUMENTS

| | | | |
|---|---|---|---|
| 2,281,754 | 5/1942 | Dalzell | 165/76 X |
| 3,661,203 | 5/1972 | Mesher | 165/167 |
| 4,308,915 | 1/1982 | Sanders et al. | 165/166 |
| 4,378,837 | 4/1983 | Ospelt | 165/166 |

FOREIGN PATENT DOCUMENTS

| | | | |
|---|---|---|---|
| 2736813 | 3/1979 | Fed. Rep. of Germany | 165/166 |
| 1470506 | 2/1967 | France | 165/166 |
| 2041190 | 9/1980 | United Kingdom | 165/166 |

*Primary Examiner*—Sheldon J. Richter

*Attorney, Agent, or Firm*—James R. Haller

[57] ABSTRACT

A heat exchanger plate block is comprised of a stack of consecutive, spaced, parallel rectangular plates mounted within an enclosing frame. The frame has end walls parallel to the plates and corner posts extending between and joining corners of the end walls. Resilient spacers are included between the plates to render the stack of plates elastically compressible as a unit in a direction normal to the planes of the plates. Resilient corner spacers are provided to space corners of the plates from adjacent corner posts to accommodate growth of the plates due to thermal expansion in their planes. The plates of the plate stack hence float within resilient fixtures which accommodate thermal expansion parallel to and normal to the planes of the plates.

29 Claims, 21 Drawing Figures

FIG. 10
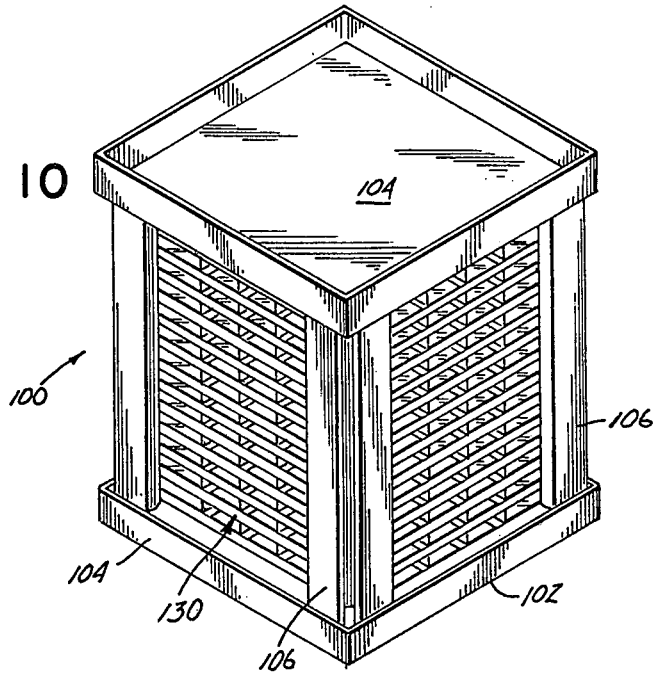
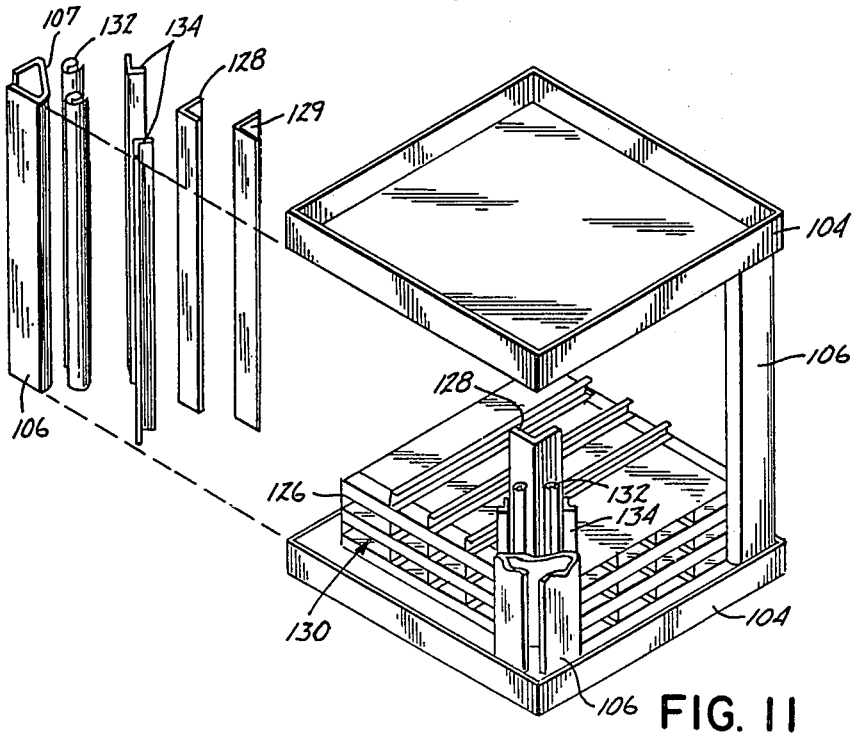
FIG. 11

FIG. 14
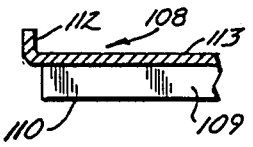
FIG. 15
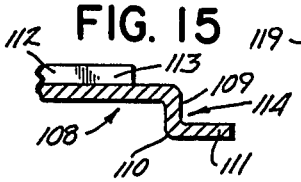
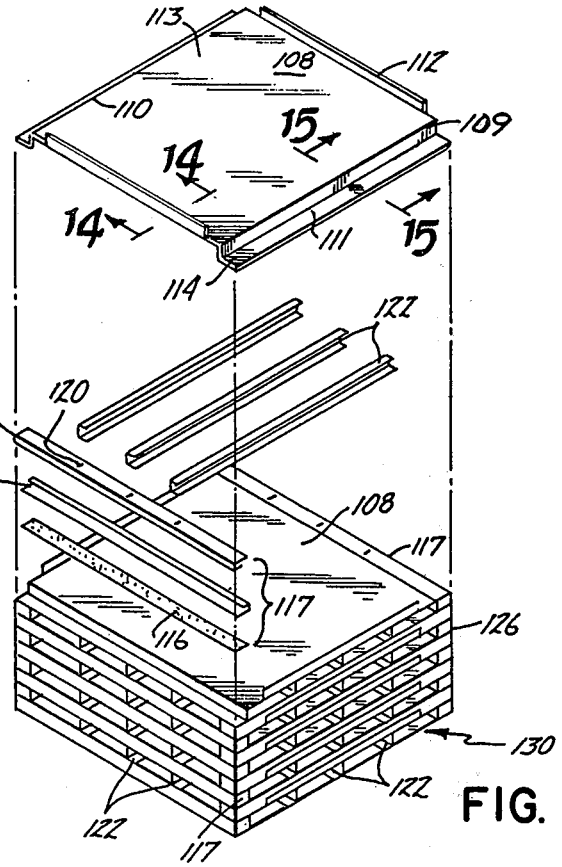
FIG. 13
FIG. 16
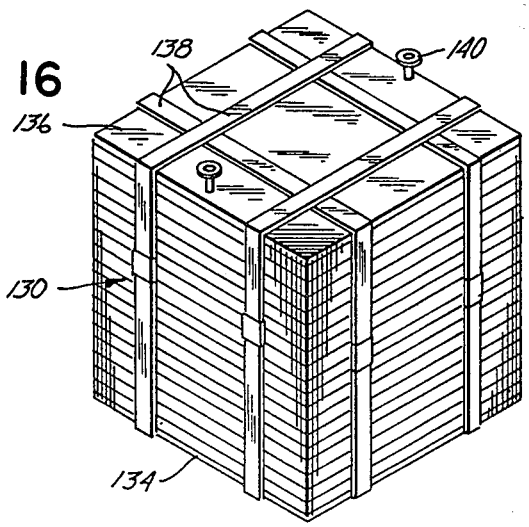

FLOATING PLATE HEAT EXCHANGER

CROSS REFERENCE TO RELATED APPLICATION

This is a continuation-in-part of co-pending U.S. application, Ser. No. 369,279, filed Apr. 19, 1982.

FIELD OF THE INVENTION

The present invention relates to plate type exchangers and more specifically to a new method of mounting exchanger plates, without welding, within an enclosing frame.

The exchanger of the present invention is primarily intended for but not limited to applications in the field of heat recovery, e.g., by exchanging heat between a hot stream leaving a process and a cold stream entering the process. Specifically a heat exchanger according to the present invention can be employed as an air preheater for furnaces, boilers, incinerators, shale oil retorting and the like.

BACKGROUND ART

In heat recovery systems the two fluids are usually gases, the temperature difference is not large and the allowable pressure drop is small. These conditions usually lead to the requirement of a large heat exchange surface. In addition, since the gases are usually corrosive, poisonous or explosive when mixed, the heat exchanger must present good corrosion resistance and good sealing of the two streams. Also, since the quality of the heat recovered is usually low, the heat exchanger must be sufficiently inexpensive to justify the cost of the investment. These conflicting requirements are not always met by existing heat exchangers.

Several types of heat exchangers are currently being employed for heat recovery. One such type is the regenerative heat wheel formed by a wheel of high thermal capacity which rotates and transports heat between the two streams. This type presents the severe disadvantage of leakage between the two streams and to the environment, and may result in appreciable loss of pumping power. Leakage may preclude application when the admixture of the two gases may cause fires or when the gases are poisonous. Another heat exchanger utilizes cast finned tubes. These exchangers are heavy and bulky, and present low resistance to both low and high temperature corrosion. To overcome these disadvantages several attempts have been made to employ thin corrugated metal sheet. The corrugations serve to support the plates against the pressure difference of the two streams. In U.S. Pat. No. 4,029,146, the corrugated metal sheets are mounted within a metal casing. The corrugated rims on two adjacent plates serve to separate the plates and form narrow channels through which the two fluids must flow. In many applications this arrangement presents the disadvantage that the narrow passages can become clogged by soot or other solid deposits, and differential thermal expansion between casing and plates also constitutes a problem. Other parallel plate heat exchangers are shown in U.S. Pat. Nos. 4,308,915, 1,727,124 and 2,368,814, United Kingdom Pat. Application No. 2,041,190A and France Pat. Application Nos. 75 20285 and 78 31863.

DISCLOSURE OF INVENTION

In one embodiment, the invention provides a heat exchanger plate block providing alternating cross-flow channels for heat exchange between two fluid streams, the block comprising a stack of consecutive, spaced, parallel rectangular plates mounted within an enclosing frame having generally rectangular end walls parallel to the plates and corner posts extending between and joining corners of the end walls. The plate block is characterized by including resilient separators between the plates to render the stack of plates elastically compressible as a unit in a direction normal to the planes of the plates. The end walls and corner posts desirably compress the stack of plates sufficiently to restrain the plates from gross movement in their planes, but the compression is limited to allow for further compression of the stack to enable the stack to internally absorb growth due to thermal expansion in the direction normal to the plane of the plates. This embodiment is further characterized by including resilient corner spacers spacing corners of the plates from adjacent corner posts to accommodate growth of the plates due to thermal expansion in a direction parallel to their planes. Thus, in this embodiment, growth due to thermal expansion normal to the planes of the plates is internally absorbed and the plate stack is permitted to expand in the plane of the plates, such expansion being accommodated by the resilient corner spacers at the plate corners.

Desirably, this embodiment further is characterized by including supportive ribs extending across and between the plates, the ribs on opposite sides of each plate lying at right angles to each other. The ribs lying against similarly facing surfaces of alternating plates desirably are parallel and are positioned identically with respect to edges of the plates. That is, the ribs lie in spaced planes that are normal to the planes of the plates and that intersect each other at right angles with the intersection extending normal to the planes of the plates. When extreme temperatures or pressures are encountered, the ribs serve to maintain spacing between the plates and, when full contact between the ribs and the plates occurs under such extreme circumstances, the criss-crossed ribs form, with the plates, a series of structurally supportive columns extending in a direction normal to the planes of the plates to support the plates against warping or other gross movement.

The invention also relates to a heat exchanger plate useful in the heat exchanger of the invention, the plate being generally rectangular and having two opposed edges each having a portion extending in the same direction generally normal to the plane of the plate and terminating in a flange extending outwardly and parallel to the plane of the plate. The remaining opposed edges of the plate are provided with upwardly-bent portions, and, desirably, the length of the latter portions is less than the maximum length of the plates taken in the same direction.

A further embodiment of the invention is characterized in that the plates are provided with a plurality of elongated dimples, the dimples of each plate extending closely adjacent the confronting surface of an adjacent plate and the dimples formed in consecutive plates being at right angles and straddling each other. The dimples in alternating plates are identically positioned. In this manner, the aligned and criss-crossed dimples in consecutive plates lie in planes that intersect along lines normal to the planes of the plates. When the plate block is used under severe conditions in which the dimples of each plate contact the confronting surface of an adjacent plate, the dimples and plates coact to form structurally supportive columns extending normally of the planes of the plates to restrain buckling or warping of the plates. The elongated dimples preferably are formed with their longest dimension in the direction of the intended fluid flow. The longest dimension of each dimple substantially exceeds the shortest dimensions of adjacent dimples in adjacent plates.

The exchanger according to the present invention utilizes heat exchange surfaces of plane parallel plates made of corrosion resistant material, the plates forming a pattern of crossflow channels. Pressure differentials between fluids is compensated by means of spacers, e.g., ribs or dimples, placed inside the channels. Sealing of the cross-flow channels with respect to the two streams is realized by pressing adjacent plate edges resiliently toward one another with the aid of a rigid frame. Desirably, each plate is provided with resilient supports which permit free expansion in all directions while maintaining adequate sealing. That is, each plate virtually floats within resilient fixtures. This unique "floating plate" concept further allows economic utilization of expensive plate materials such as high alloy metals which can be employed as thin sheet or even frail materials such as ceramic or glass. The corners of the plates preferably are not notched or cut-away but rather are full; the plates, in plan view, desirably are substantially perfect rectangles.

In a preferred embodiment, the heat exchanger comprises one or more blocks of rectangular exchanger plates, the plates being assembled in such manner as to provide in each block a pattern of crossflow channels for the two fluid streams involved in the heat exchange process. The heat exchange surfaces are essentially plane rectangles and are made preferably of corrosion resistant material such as metal alloys, ceramic, glass or the like. The thickness of said exchanger plates is selected with consideration given to material strength and corrosion resistance, and is made as small as possible. A plate block is formed by stacking together a plurality of exchanger plates, separating said exchanger plates from each other by a system of at least partially resilient plate separators and enclosing the thus formed assembly in a rigid metal frame. The frame also serves to compress the plate stack such that the edges of adjacent plates are pressed toward each other to provide a good seal. By this procedure, the necessity of welding or otherwise soldering the plate edges is eliminated. Desirably, each plate is supported elastically and essentially independently from adjacent plates; each plate floats substantially freely within resilient fixtures. A stack of floating plates is realized by placing resilient edge separators on two opposing edges of each plate and rigid edge separators on the remaining two edges. The resilient and rigid separators are normally staggered by 90° for each two adjacent plates. A plate stack is thus realized which is compressible in a direction perpendicular to the planes of the plates. The thus formed compressible plate stack is compressed by the frame to achieve tight assembly; yet, sufficient expansion allowance is provided to accommodate the expected thermal expansion during use. In this manner, thermal expansion is compensated locally by small displacement of each plate without cumulative large scale movement, and the number of plates in a stack can be made arbitrarily large.

Inside each of the flow channels formed by each two adjacent plates, spacers are placed to help support the plates against pressure differences of the two streams. The spacers are placed such as to not obstruct the fluid flow in the corresponding channel and are in sufficient number such that the pressure force on a free plate span (between spacers) does not cause unduly large stresses within the plate. The spacers can be provided, e.g., in the form of beams affixed onto crossbars placed in the inlet and outlet areas of each channel. Alternatively the spacers can be formed integral with the plate by stamping or other affixation procedures.

The enclosing frame of a plate stack includes four corner posts and two end walls. The material is preferably metallic. The end walls are positioned parallel to the exchanger plates and at the two ends of the plate stack, and are connected to the four corner posts desirably by bolting. The frame also serves to support the weight of the plate stack. A resilient seal is placed between each corner post and the corresponding corner portion of the plate stack, thus sealing the two streams from each other while allowing free thermal expansion of each plate in its own plane. An essentially rectangular frame is thus achieved which envelopes the plate stack to form a plate block. Flanging areas provided with bolt holes are also provided by rims of the rectangular frame for connection of the plate blocks to each other and to external duct work.

The plate block as described can be used singly as a single pass crossflow heat exchanger or, it can be used singly and in conjunction with stream dividers as a multiple pass crossflow-counterflow heat exchanger or again, it can be connected to similar blocks to form a multipass crossflow-counterflow heat exchanger. Other combinations of flow patterns are also possible. A heat exchanger is thus achieved which provides good separation of the two fluid streams, and is free from leaks to the environment. Compared to a conventional cast finned tube heat exchanger for the same duty, the floating plate exchanger has a small bulk volume, reduced weight and reduced pressure drop. Clogging by soot from combustion gases does not constitute a problem with the present exchanger since there are no narrow passages and soot can be removed by conventional sootblowers.

BRIEF DESCRIPTION OF DRAWINGS

FIG. 10 is a perspective view of a modified plate block of the invention;

FIG. 11 is a view similar to that of FIG. 10 but showing the plate block broken away, in partial cross-section and with a portion thereof exploded for clarity;

FIG. 13 is an exploded, schematic, perspective view of a plate stack employed in the invention;

FIG. 14 is a broken-away, cross-sectional view taken along line 14—14 of FIG. 13;

FIG. 15 is a broken-away, cross-sectional view taken along line 15—15 of FIG. 13;

FIG. 16 is a perspective, largely diagramatic view of a plate stack intended for use with the device FIG. 10;

BEST MODE OF CARRYING OUT THE INVENTION

Figure 1:
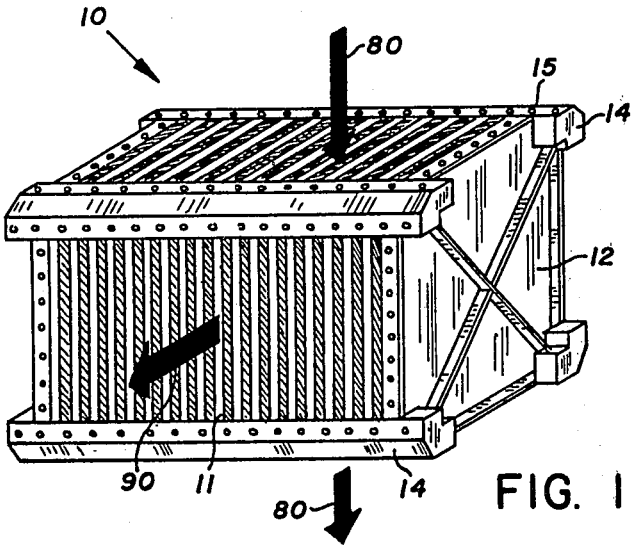
FIG. 1 is a perspective view of a heat exchanger formed of a single plate block.
Figure 2:
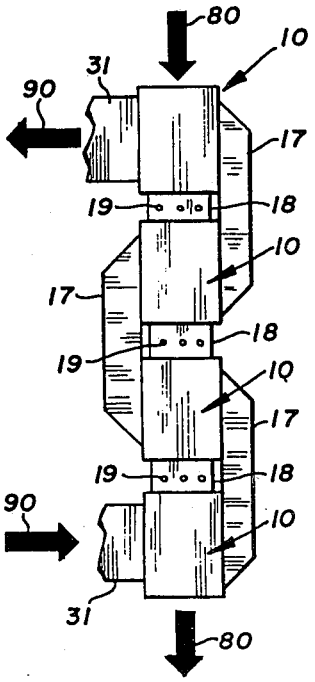
FIG. 2 is a diagram of a multiblock heat exchanger.
Figure 3:
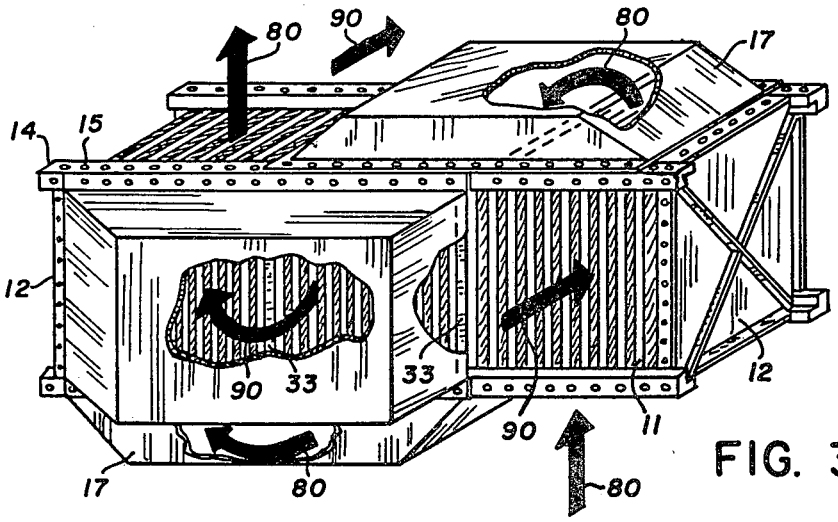
FIG. 3 is a perspective view of a multipass heat exchanger formed of a single plate block with stream dividers.
Figure 8:
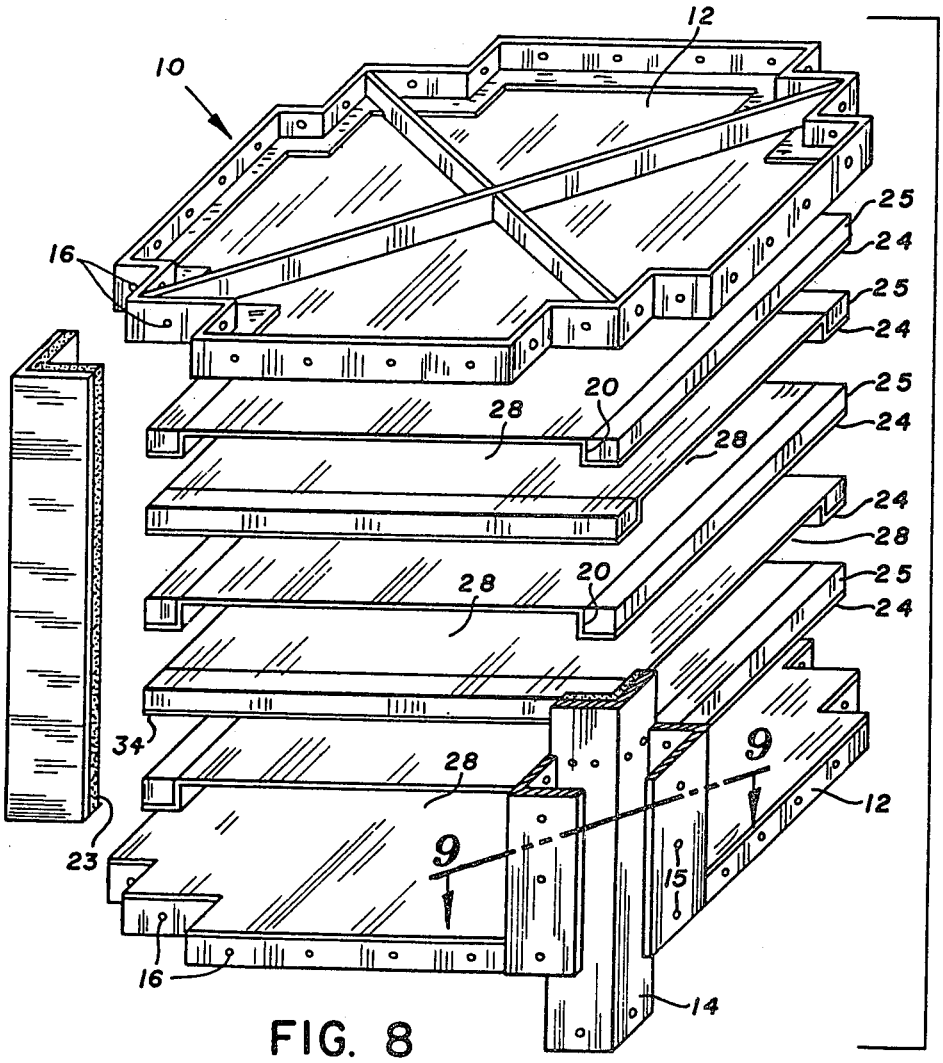
FIG. 8 is an exploded view of a plate block showing frame components.
Figure 12:
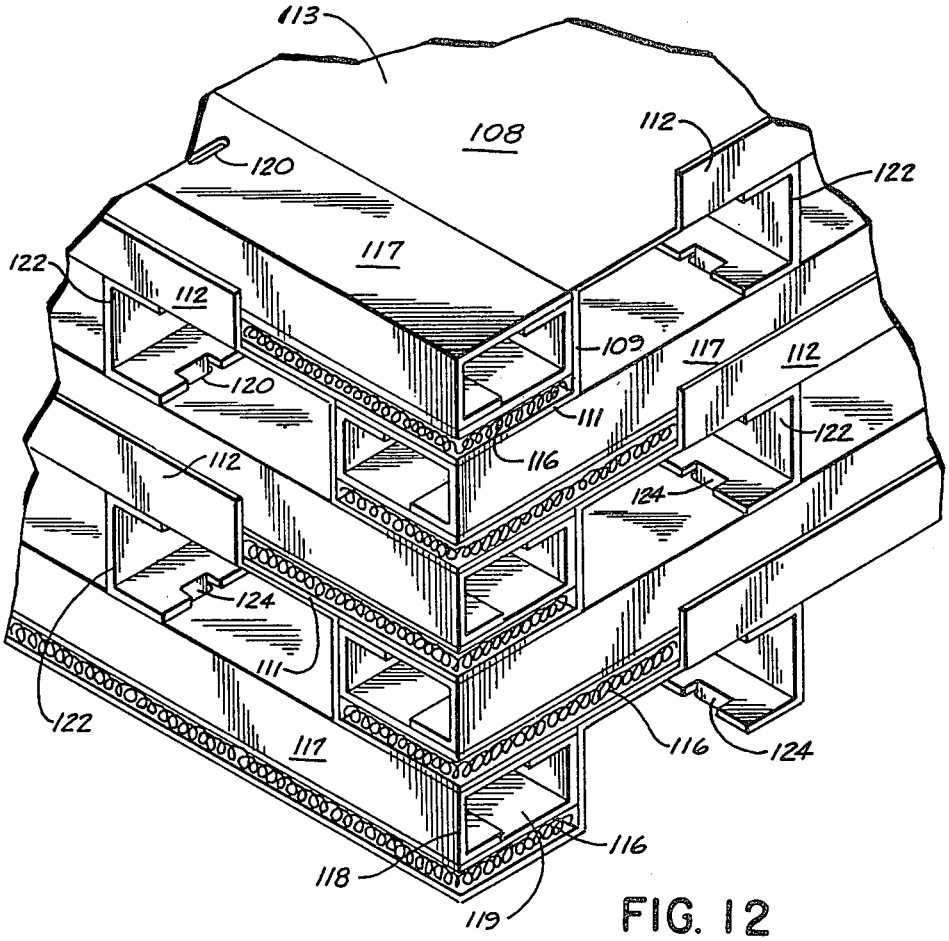
FIG. 12 is a broken-away, perspective view of a plate stack of the type employed in the embodiment of FIGS. 10 and 11.
Figure 17:
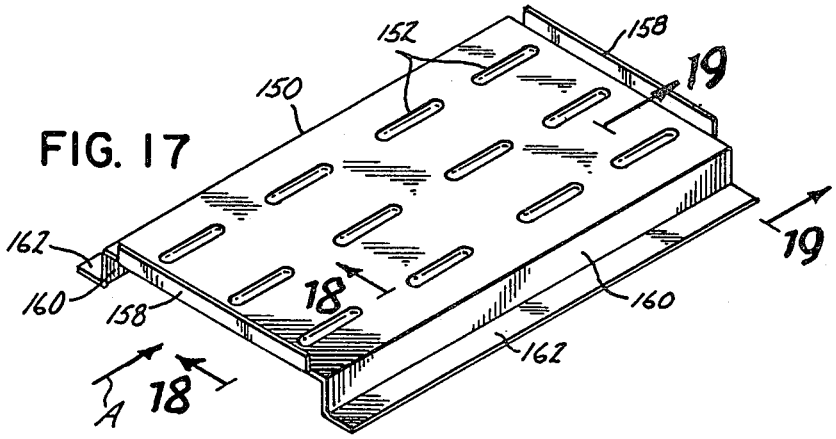
FIG. 17 is a perspective view of a plate of a modified heat exchanger of the invention.
Figure 18:
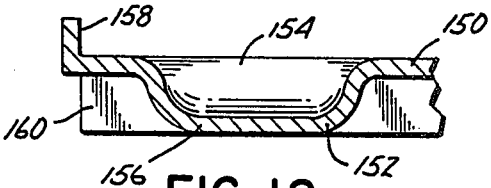
FIG. 18 is a broken-away, cross-sectional view taken along line 18—18 of FIG. 17.
Figure 19:
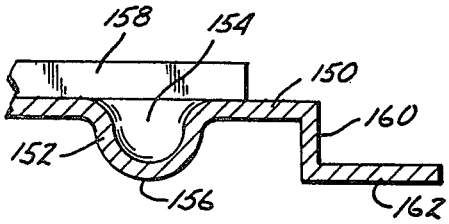
FIG. 19 is a broken-away, cross-sectional view taken along line 19—19 of FIG. 17.

The plate block (10) is principally composed of a plurality of exchanger plates (11) in an enclosing frame which generally comprises end walls (12) and corner posts (14) (FIGS. 1, 3 and 8). Plate block (10) can be employed singly to form a crossflow exchanger (FIG. 1) or, in combination with other plate blocks (10) to form a crossflow-counterflow exchanger (FIG. 2). A single plate block (10) can also form a crossflow-counterflow exchanger by making use of stream dividers (33) to direct the flow (FIG. 3). A stream divider (33) may be affixed to two adjacent support channels (14) and to one of the exchanger plates (11). In the exchanger thus achieved, heat can be transferred between two fluid streams (80) and (90) which are generally at different pressures and flow through said exchanger separately and in a crossflow manner.

Figure 4:
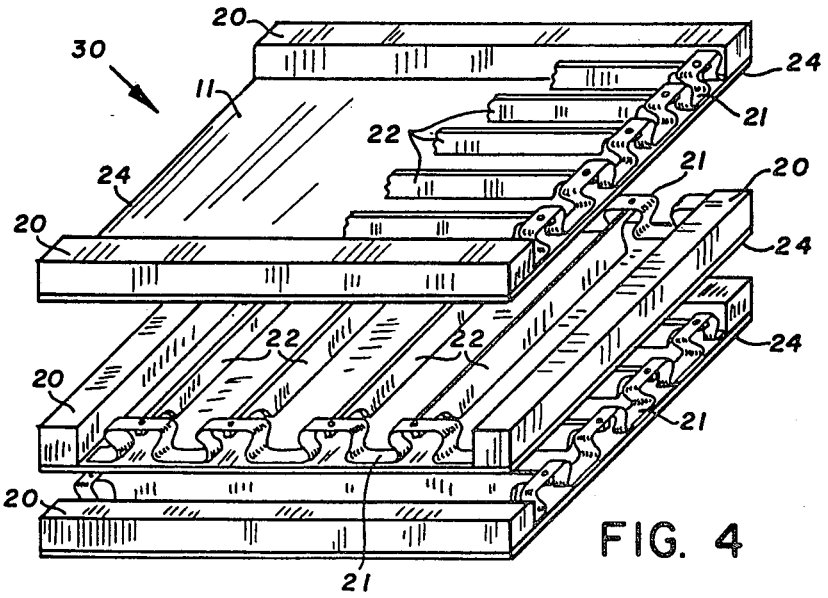
FIG. 4 is an exploded, partially broken-away view of a plate stack formed of plane rectangular exchanger plates.

Referring particularly to FIG. 4, the exchanger plates (11) are disposed parallel to each other in a plate stack (30) through the intermediary of a number of spacers (22), rigid edge separators (20) and elastic edge separators (21). The thus formed assembly is then tightly enclosed between the two end walls (12) (FIG. 1) which are bolted or otherwise affixed to the four corner posts (14). The exchanger plates (11) are essentially rectangular in shape and can be made of metal sheet, ceramic plate, glass plate or other material. The exchanger plates (11) thus form a number of parallel flow channels (28) through which fluids (80) and (90) flow.

Figure 5:
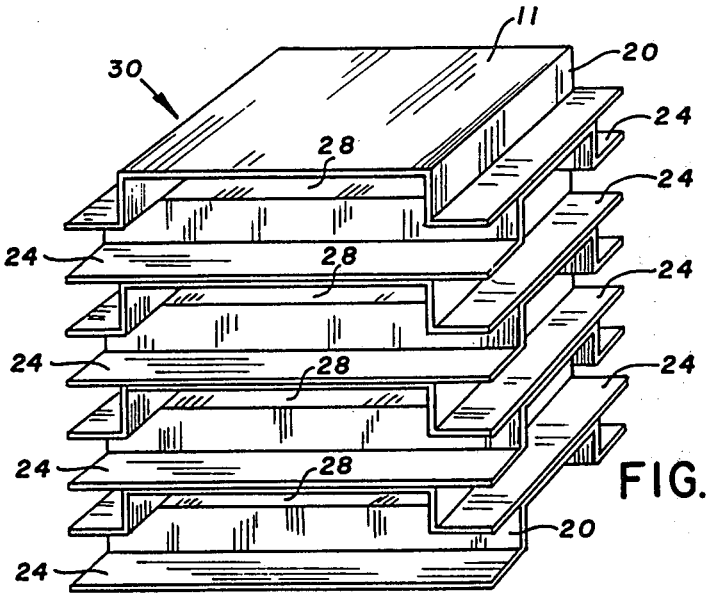
FIG. 5 is an exploded view of a plate stack formed of rectangular exchanger plates with folded edges.

In order to direct the flow in a crossflow manner, rigid edge separators (20) are employed which are essentially rigid bars disposed at two opposing edges of each plate and staggered sequentially through 90°. The rigid edge separators (20) can be provided as detachable components of the plate stack (30) as shown in FIG. 4. Alternatively, the rigid edge separator (20) can be formed as a fold (20) of the exchanger plate (11) as shown in FIG. 5. In the latter case, said edge of the exchanger plate (11) is first folded 90° forward (normal to the plane of the plate) to form a rigid edge separator (20) and then folded 90° backward (outwardly and parallel to the plane of the plate) to form plate edge contact area or flange (24). Thus, several exchanger plate configurations can be employed in the invention. One configuration is simply a plane rectangle as shown in FIG. 4. This type is preferable with frail plate materials such as ceramic or glass. Another type is a rectangular plate with folded opposing edges as described above and as shown in FIGS. 5, 6, 7 and 8. This type is preferred with metal plates. It presents the advantages of providing a recessed space which can be used for the placement of crossbar (25) in such a way that it does not constitute an obstacle to fluid flow. A recessed space such as formed by the folded plates may also be realized with plane rectangular plates by recessing the rigid edge separators (20) and correspondingly trimming the plate size. The last arrangement is not pursued further in this description of a preferred embodiment.

Figure 6:
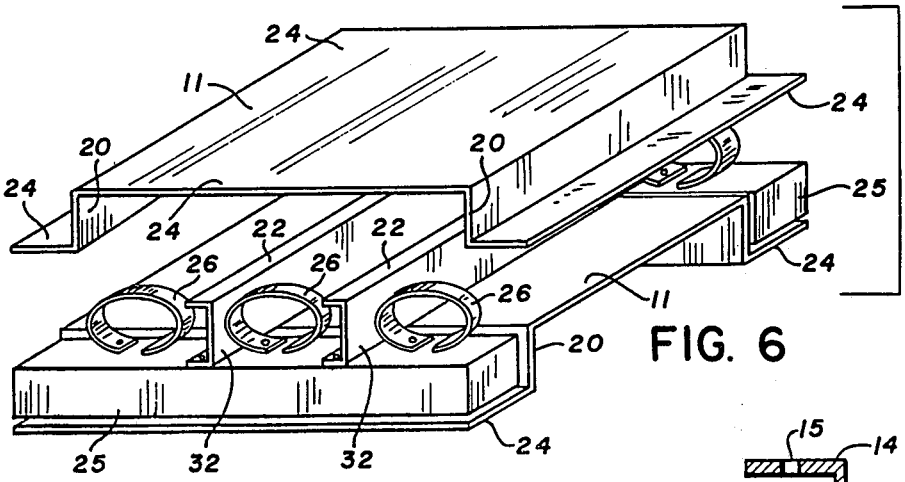
FIG. 6 is a perspective view of a flow channel between two exchanger plates.
Figure 7:
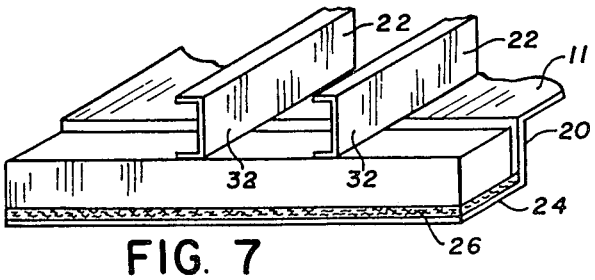
FIG. 7 is a broken-away, perspective view of a resilient edge separator utilizing a resilient, compressible strip.

Referring again to FIGS. 4 and 6, the two remaining opposing edges of each exchanger plate (11) are supported by elastic edge separators (21) which are formed of a subassembly consisting of crossbar (25) and springs (26). Crossbar (25) is essentially a rigid bar extending the entire length of the corresponding plate edge. Springs (26) can be provided in a variety of forms of which two are selected for the purpose of typifying this preferred embodiment. One form is shown in FIG. 6, in which said elastic edge separator consists of the crossbar (25) on top of which a number of leaf springs (26) are affixed by notching or other procedure. Leaf springs (26) are compressed between the crossbar (25) and the plate edge above it. Another preferred form is shown in FIG. 7 in which a resilient strip (26) is placed under the crossbar (25) and edge spacers (32) are affixed on top of crossbar (25). Edge spacers (32) can be simply provided by the extended ends of the spacers or ribs (22). The strip (26) is compressed between crossbar (25) and the plate edge under it. The compressible, resilient strip (26) plays the role of a spring and, in this specific embodiment is not relied upon for the purpose of sealing. The strip (26) can be formed of ceramic fiber, wire mesh or other materials, and preferably extends through the length and width of the flange (24).

The principal role of the resilient edge separator (21) (FIG. 4) is to absorb locally the differential thermal expansion between the plate stack and the enclosing frame. Another role of this separator is to aid the sealing of flow channels by pressing the plate edge contact areas (24) of two adjacent plates against each other. In cold conditions, the dimension of the resilient edge separator (21) in the direction perpendicular to the exchanger plate plane is somewhat larger than the corresponding dimension of the rigid edge separator (20) and that of the spacers (22). Then, upon warming up, edge separators (20) and spacers (22) thermally expand while springs (26) are compressed. The natural flexibility of the exchanger plate helps maintain a good seal along the plate edge contact areas 24 at all temperatures, with only very small local displacements. The local absorbtion of the thermal growth by the resilient edge separators (21) is an important feature of the present invention. In an exchanger with a large number of plates, not provided with springs, the cumulative thermal growth can be appreciable and can lead to unacceptably large stresses in the plate stack and the enclosing frame. With the use of springs (26) the pushing force on the end walls (12) depends upon the strength of the springs, which can be controlled by design.

As mentioned, each flow channel (28) contains a plurality of spacers or ribs (22) with a width (measured normal to the planes of the plates) approximately equal to that of the flow channel (between plates). Spacers

(22) can be realized in the form of detachable beams affixed to the crossbars (25) by notching or other equivalent procedure, as shown in FIGS. 4, 6 and 7. Alternatively, spacers (22) may be formed in a variety of shapes from the exchanger plate itself. Spacers (22) serve generally to reinforce the composite structure and help support the exchanger plates (11) against the pressure difference of the two streams.

Figure 9:
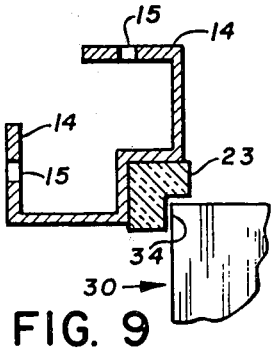
FIG. 9 is a broken-away cross section taken along line 9—9 of FIG. 8.

The plate stack as described above is placed inside the enclosing frame in close contact with the end walls (12) and with sufficient clearance allowed between the corners (34) of the plate stack (FIGS. 8 and 9) and the corner posts (14) to accommodate thermal growth of the exchanger plates in their planes. Along the corner posts (14), the separation of the two fluid streams is achieved by means of the resilient seal (23) which can be a ceramic fiber packing or other packing with sufficient resiliency and adequate sealing properties.

By the above combination of parts, manifolds for the distribution of the two fluids at the inlets and outlets of plate block (10) are also afforded. A manifold can be viewed as being comprised of two adjacent corner posts (14) and the rims of the two end walls (12), the rigid edge separators (20) providing closure of part of the flow channels (28) and the elastic edge separators (21) providing fluid admission openings on the remaining flow channels (28).

As shown in FIGS. 1, 3 and 8, the end walls (12) and corner posts (14) also present bolt holes along their rims. The frame assembly bolt holes (16) serve to admit bolts for connecting the end walls (12) to the four corner posts (14). The block connecting bolt holes (15) serve to admit bolts for connecting blocks to each other and to the external duct work (31) (FIG. 2). FIG. 2 depicts a heat exchanger composed of four plate blocks (10), providing one flow pass for fluid (80) and four flow passes for fluid (90). Fluid (80) may be stack flue gas and fluid (90) may be air. The turns (17) in the duct work serve to direct the air flow through the four blocks in series. Sootblowers 19 of known design may be installed between the blocks as depicted. With clean flue gas, sootblowers (19) and block connectors (18) can be omitted.

A simple method of fabrication of a floating plate exchanger follows. The exchanger plates (11) are rectangular in shape and are typified as being made of stainless steel sheet. Two opposing edges of each plate are folded as described above to realize the rigid edge separators (20). The spacers (22) and the crossbars (25) may be formed of stainless steel plate by folding to form appropriately shaped hollow beams. The various frame components may be made of thick carbon steel plate and of the general shape presented in the drawings. The assembly of plate block (10) is then commenced by building a plate stack on one of the end walls (12), the latter serving as a building base. Plates are placed in the stack one by one and alternately 90° staggered. On each plate the crossbars (25), springs (26) and spacers (22) are placed before adding the next plate. After completion of the plate stack the other end wall (12) is placed on top of the stack. Subsequently the stack is compressed between the two end walls (12) by means of clamps placed around the rim of the end walls to the limit of resilient compression, and the end walls are then moved apart a small distance to afford the stack a measure of resilient compressibility. The corner posts are positioned with the resilient corner seals (23) in place and the frame assembly bolts (16) are tightened. The plate block can now be tilted into the normal position with the exchanger plates vertic- al. Several similar plate blocks are usually bolt tied together to form a heat exchanger. As can be seen, the various component parts are assembled with- out welding or other soldering procedure. Thus the parts remain detachable for disassembly purposes such as would be required for cleaning or for replacing plates damaged during operation.

The heat exchanger of the present invention presents the advantages of easy cleanability, corrosion resistance and small weight and sizes when compared to other recuperative heat exchangers in similar applications. The easy cleanability results from the wide channels which, in a preferred embodiment, are free from obstacles such as finning or corrugations. The small sizes result from the good packing properties of plane sheets when compared to finned plates. Since with the present invention the heat exchange surface can be realized of thin sheets, economic use can be made of relatively expensive corrosion-resistant materials such as stainless steels. Low temperature corrosion resistance can be further aided by applying a protective coating such as poly (tetrafluoroethylene) on the exchanger plates of the low temperature plate block. High temperature corrosion can be prevented by using higher grades of stainless steel or ceramic material for the exchanger plates.

The relatively small sizes and weight further allow natural draft applications, e.g., for installation on top of an existing structure.

The exchanger further presents the advantage of flexibility of design since a given heat transfer requirement can be fulfilled by judicious selection from among a large set of design parameters such as plate spacing, plate dimensions, number of plates in a block and number of blocks. This design flexibility makes it possible to satisfy the constraints usually associated with applying an airpreheater to an existing furnace or boiler.

Another important advantage of the present invention is the easy replacement of possibly damaged plates after a period of operation.

Several of these advantages are illustrated below by an example. Consider an airpreheating application on a process furnace in which fluid (80) is stack flue gas and fluid (90) is combustion air. The flue gas temperatures at the inlet and outlet of the airpreheater are respectively 392° C. and 200° C. and those of the air are 20° C. and 280° C., giving a mean temperature difference of 138° C. The flue gas flow rate is 12 Kg/sec and that of the air is 10 Kg/sec, giving a heat transfer duty of 2.65 MW. The design of a floating plate exchanger which fulfills these requirements can be accomplished in many different ways depending on the constraints imposed on sizes, pressure drop and type of fuel burned in the furnace. Thus, assume that the flue gas is to be circulated solely by the natural draft procured by a stack and that the fuel burned is heavy residual oil. Due to possible fouling with this fuel, sootblowers must be provided and the plate distance on the flue gas side is chosen large, of 22 mm. The plate separation on the air side is chosen as 12 mm. The plates are made of stainless steel sheet, 0.6 mm thick. By applying well known heat transfer formulas it is found that for a pressure drop of 60 Pa on the flue gas side and 220 Pa on the air side the heat transfer surface required is 1050 $m^2$. This is provided by three plate blocks with the general arrangement of FIG. 2. The overall dimensions of a plate block (including frame) are: height, 1.5 m, width, 2.5 m, and depth, 2.8 m. The bulk volumes of the three blocks together is 31.5 $m^3$. The total weight of the heat exchanger is 10,000 Kg. The overall sizes can be greatly reduced for a clean burning fuel such as natural gas and by employing forced draft. Thus, for the above conditions, for a pressure drop of 735 Pa flue gas and 1000 Pa air, and for a plate distance of 12 mm on both sides, the heat transfer surface can be reduced to 475 $m^2$. In this case the bulk volume is 11.2 $m^3$ and the total weight is 5000 Kg.

Preferred embodiments of the invention are depicted in FIGS. 10–21. Referring first to the embodiment of FIGS. 10–13, a plate block is depicted as (100) and includes a frame (102) formed of parallel, rectangular, rigid end walls (104) having corner posts (106) extending between and rigidly joining the end walls at their corners. The corner posts may be affixed to the end walls by any appropriate means such as that described above in connection with FIGS. 1, 3 and 8, by welding, or by longitudinal bolts passing through the end walls within and parallel to the corner posts. Carried between the end walls are a series of stacked plates (108). Each plate desirably is generally rectangular and has two opposed edges appropriately bent to provide in each a portion (109) extending in a direction generally normal to the plane of the plate and having a lower edge (110) and an outwardly extending flange (iii) extending parallel to the plane of the plate from the lower edge (110). The other edges of the plate have bent portions (112) that extend upwardly, that is, in the opposite direction to the portions (109), to provide increased rigidity. The length of the portion (112), measured along its longest dimension, is substantially less than the corresponding length of the plane portion (113) of the plate. As will be understood from the description below, the next consecutive plate in the stack will be similarly bent, but will be turned to 90° with respect to the preceding plate. For each plate combination, the distance measured parallel to the plane of the plate between the edges of the flanges (111) is slightly less than the distance, measured parallel to the plane of the plate, between the upwardly turned portions (112) of the next adjacent plates so that the plates may interfit or nest as shown best in FIG. 12. The upwardly turned portions (112) have been omitted from certain of the plates in FIG. 13 for purposes of showing internal structure.

In a manner similar to that described above, the plate block (100) may be assembled by utilizing one of the end walls as a horizontal base and laying up on that wall successive plates and other elements. It will be understood that the bottom-most plate may be formed without the downwardly and outwardly-bent configuration shown at (109) and (111) in FIG. 13, and the upwardly-turned edge (112) may be omitted from the top-most plate.

The embodiment of FIGS. 10–13 includes resilient edge separators (116) desirably shaped and sized to lay flatly within the channel (114) (FIG. 15) formed by the bent portion (109) and flange (111) of each plate (108). Upon each resilient edge separator (116) is placed a rigid spacer (117) desirably formed of interlocking, generally U-shaped channels (118) and (119) (FIG. 13), the spacers desirably having slots (120) formed in their upper surfaces. The height of the spacers (117) is such that, when the elastic edge separators (116) are uncompressed, the upper surface of the spacer (117) is slightly raised above the adjacent plane surface (113) of the plate.

Extending across each plate are a series of spaced ribs (122), the ribs extending into overlying contact with the spacers (117) and the ribs including downwardly struck tangs (124) adjacent the rib ends which are received within the slots (120) in the spacers to maintain the ribs (122) in their spaced, parallel orientation with respect to the plate block. The ribs preferably have a generally "C" shaped cross-section with legs of the "C" desirably being spread slightly to provide some resilience to the rib and the legs lying adjacent confronting plate surfaces. The slots (120) formed in the spacers orient the ribs so that the ribs passing in one direction across the plate are aligned in vertical planes and the ribs passing in the other direction across the plate similarly lie in vertical planes which intersect the first-mentioned planes, the intersections being vertical; that is, at right angles to the plane of the plates. The upwardly-turned portions (112) formed on each plate serve to restrain edges of the outwardly-turned flanges (111), the upwardly-turned portions (112) thus serving to rigidize the plates and to aid in locating the plates during assembly.

Referring now to FIG. 11, the corner posts (106) may be generally triangular in shape, presenting generally flat surfaces (107) to the corners of the plate stack. A plate stack corner is shown at (126) in FIG. 11, and against the corner (126) may be placed a generally right-angled sealing strip (128) of metal or other material. In some situations it is desirable to employ yet a second sealing strip (129) of silicone rubber or other yieldable material between the sealing strip (128) and the corner (126) of the plate stack. Positioned between the surface (107) of the corner post (106) and the confronting surfaces of the sealing strip (128) are elongated resilient corner spacers. In the drawing (FIG. 11), the spacers are typified as lengths of a springy metal such as inconel rolled into scrolls (132), the scrolls presenting resiliently deformable surfaces to the confronting surfaces of the sealing strip (128) and support channel (106). The scrolls (132) may be supported at their sides by angular supports (134). It will be understood that the sealing strips (128) are not rigidly attached to the end walls, but are held in place by spring pressure between the corners of the plate stack and the resilient corner spacers.

The plate stack (130), formed as described, is readily compressible in a direction normal to the planes of the plates because of the inclusion of the resilient edge separators (116). The top end wall (104) is placed upon the plate stack, and the end walls are compressed toward one another until the desired degree of compression has been obtained, following which the corner posts are rigidly fastened to the end walls to maintain said compression.

Compression of the plates in this manner tends to substantially seal the adjacent edges of the plates to one another, but the compression is not so severe as to crush the plate stack. Sufficient potential for further compression is permitted so as to enable the plate stack to internally absorb growth due to thermal expansion of the plate stack in a direction normal to the planes of the plates. Different degrees of compression, of course, are required for different usage conditions. As a rule of thumb, adequate compression often can be accomplished by pressing the end walls together with a force equivalent to the weight of the plate stack itself.

Compression of the plate stack in this manner may cause some permanent deformation in the resilient spacers between plates, but such deformation is unimportant provided that the spacers retain sufficient springiness or resiliency to absorb dimensional changes due to thermal expansion in a direction normal to the planes of the plates.

In the resulting plate block (100) as depicted in FIG. 10, thermal expansion of the plate stack in a direction normal to the planes of the plates is absorbed internally of the stack, and thermal expansion of the plates in their planes is absorbed by the resiliently deformable scrolls (132). In the event that exceedingly severe temperatures are encountered, or unduly high stream pressures are employed, the ribs (122) serve to maintain spacing between confronting surfaces of the plates, and, under such conditions, the ribs themselves form with the plates supportive, structural columns extending along the intersections of the planes of the ribs normal to the planes of the plates to provide extra support. The slightly spread legs of the C-shaped ribs (132) also permit the ribs to deform slightly upon severe compression.

Since manufacture of the plates and of the frame require generally different tooling and utilize workmen skilled in somewhat different fields, the plate stack and the frames often may be manufactured at separate locations. Also, it may be desirable in some instances to simply replace the plate stack of a plate block at the use site without removing the frame. For these reasons, among others, it may be desirable to provide the plate stack as an integral unit in condition to be inserted within a frame. In this event, the plates, spacers and other elements of the plate stack itself may be assembled upon a heavy, rigid bottom plate shown in FIG. 16 as (134). A heavy, rigid top plate (136) may be placed upon the top-most exchanger plate, and the resulting assembly may be compressed as desired. Clamps such as straps (138) may encircle the resulting unit to maintain the compressive force of the plates (134) and (136) upon the plate stack, and the upper plate (136) may be provided with attachment means such as eye bolts (140) so that the plate stack may be lifted by appropriate equipment as a unit and transported to the site of the frame with which the plate stack is to be used. The plates (134) and (136) are of sufficient strength as to resist significant bending at their edges due to the strap forces, and the degree of compression between the plates (134) and (136) is such that the plate stack, when supported in a vertical position (that is, with the planes of the plates extending vertically), will not slip or significantly move with respect to one another. In this manner, the plates themselves are substantially locked together due to friction forces between successive plates resulting from the relatively high compression between the plates (134) and (136).

When the pre-compressed plate stack (130) depicted in FIG. 16 is to be installed, it is placed between end walls (104) after removal of the eyebolts (140) and the end walls are positioned adjacent the plates (134) and (136) and are fastened in place with the corner posts (106). Thereafter, the straps (130) may be severed and the plate stack may expand slightly against the end walls (104). The straps (138) desirably are of thin metal, and, although they may be rendered removed entirely, their presence between the plates (136) and the end walls (104) is not harmful to operation of the device.

As previously mentioned, the frictional contact between the various elements of the plate stack (130) when the latter is compressed, although allowing for movement of the individual plates through thermal expansion, yet is sufficiently great to restrain the plates, by frictional forces therebetween, from gross movement with respect to one another when the plate stack is tipped on edge (with the planes of the plates extending vertically) and the plate stack is supported by the plates (134), (136). Desirably, the plate stack is compressed to a degree restraining the plates from gross movement under a force of two gravities or more, the compression force depending, among other things, upon the number of plates in the stack and the length (measured normal to the planes of the plates) of the plate stack. As a result, the plate stacks may be turned on edge and transported by truck or other means without incurring damage due to slippage of plates one past another.

Figure 20:
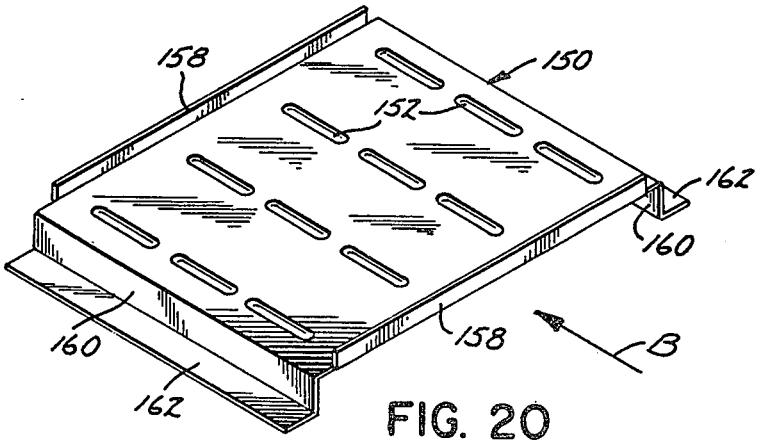
FIG. 20 is a perspective view of a plate usable in connection with the plate shown in FIG. 17.

A modified embodiment of the invention is depicted in FIGS. 17–21. In this embodiment, the plates, designated (150), are shaped similarly to the previously described plates (108) but are provided with a plurality of elongated dimples (152) in their heat exchange surfaces. The dimples preferably are formed by known metal drawing techniques utilizing appropriately shaped male and female dies. The resulting dimples, accordingly, are pressed outwardly from the plane of the plate and define recesses (154) on one side of the plate and projections (156) on the other side of the plate. The dimples preferably are rounded to avoid stress concentrations and for ease of fabrication, and accordingly are generally concave on one side and convex on the other side of the plate. The dimples shown in the plates of FIGS. 17–21 are formed downwardly into each plate, but the direction that the dimples project from the surfaces of the plates is not of importance provided the dimples all project in the same direction when the plates are assembled to form a plate stack. The dimples are elongated so that the projecting or convex portions (156) thereof are elongated in the direction of travel of fluid within the channel into which the dimples project, thereby avoiding significant resistance to fluid flow. The dimples in the plate of FIG. 17, accordingly, are elongated in the direction of fluid flow as shown by the arrow A, whereas the dimples in the next successive plate shown in FIG. 20 are elongated in the direction of fluid flow designated by the arrow B. In this manner, the dimples in alternating plates, e.g., the plates of FIG. 17, extend in the same direction and are identically positioned in the plates so that the dimples are in alignment in the direction normal to the planes of the plates when the plate stack is assembled. The dimples in the remaining alternating plates, typified by the plates shown in FIG. 20, are elongated in a direction normal to the dimples of the plate shown in FIG. 17, and similarly are identically positioned in the plates so as to be in alignment with one another in a direction normal to the planes of the plates when they are assembled. The dimples of the plate in FIG. 20, moreover, are aligned in a direction normal to the planes of the plates with the dimples of the plates depicted in FIG. 17 so that the dimples in successive plates lie in a criss-cross pattern with the intersections being aligned in a direction normal to the planes of the plates. Each dimple is sufficiently elongated as to extend beyond the elongated edges of a dimple in an adjacent plate. In this manner, the dimples serve adequately to replace the previously described ribs (122), and, when the plate stack is placed under extreme conditions of temperature or compression, the dimples form, with the respective plate surfaces, structural columns extending normal to the planes of the plates to preserve the correct spacing between plates and to restrain warping. The plates (150) desirably are used in heat exchangers intended for lower temperature usage.

Figure 21:
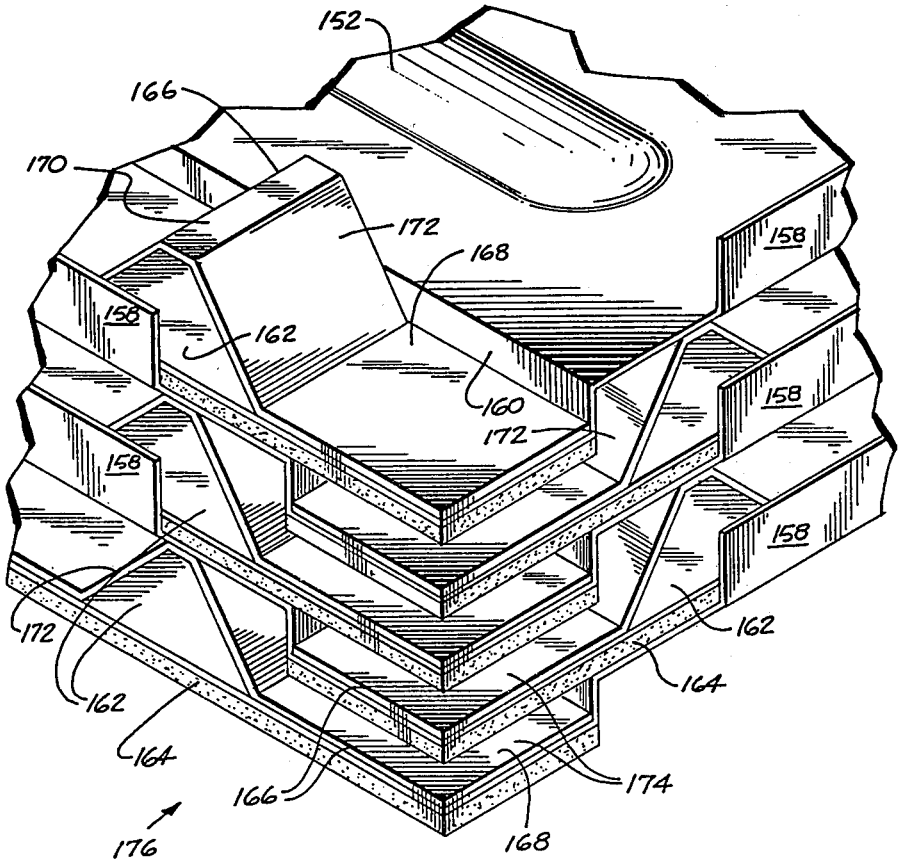
FIG. 21 is a perspective, broken-away view showing the embodiment of the invention employing the plates of FIGS. 17 and 20.

The plates (150) preferably are provided with two opposed edges which have upturned portions (158) and two opposed edges which have downwardly-turned portions (160) and outwardly-turned flanges (162) which nest in the manner shown in FIG. 21, the parallel edges of each of the flanges (162) of each plate being received between the upwardly-turned portions (156) of the next adjacent plate. The embodiment of FIG. 21 utilizes resilient edge separators (164) which, in the particular embodiment depicted, lie directly beneath the flanges (162) and bear downwardly upon the edges of the next consecutive plate adjacent the upwardly-turned portions (158). In a preferred embodiment, the resilient edge separators may take the form of strips of a resilient rubber such as a silicone rubber. Edge spacers (166) may be provided with an elongated, generally serpentine configuration as shown in FIG. 21, the spacers (166) having flattened portions (168) resting downwardly upon the flanges (162) and upward, preferably flattened sections (170) upon which the next adjacent plate rests downwardly, with generally straight bridging portions (172) bridging the flattened portions (168) and (170). The spacers (166) desirably are rigid and unyielding under the conditions of use. The height of the resilient edge separators (164) and the edge spacers (166) may be varied as desired; in the embodiment shown in FIG. 21, spaces (174) are provided between the plates at their corners. The resilient edge separators (164) may, if desired, be made sufficiently thick at their ends as to occupy the spaces (174), or generally rectangular corner separators of rubber or similar material may be employed to fill the spaces (174).

The plate stack shown generally at (176) in FIG. 21 may be assembled into a heat exchanger plate block as described above in connection with FIGS. 10 and 11, utilizing similar end plates, corner posts, sealing strips and resilient corner spacers. The embodiment shown in FIG. 21 may be precompressed into a plate stack in the manner shown in FIG. 16, if desired.

Because of the unique structure of heat exchangers of the invention, relatively large heat exchange plates of thin material can be readily assembled into sturdy heat exchange structures. The use of spaced ribs (or dimples, in one embodiment) between the spaced plates provides even large plates with relatively small unsupported spans and hence restrains the plates from buckling or other gross movement during use. The plates are not welded or otherwise rigidly affixed to one another or to the frame, and there are no weldments or other rigid connections subject to breakage during use. The plates of each plate stack, when compressed against the resilient separators, are held together largely by friction forces between the plates and the between-plate elements and thus are formed into a unitized assembly. The plates themselves are provided with freedom to grow or expand due to thermal expansion, both internally in a direction normal to the planes of the plates and also externally in a direction parallel to the plate planes, without breakage and without loss of heat transfer utility. Since the plates are not welded, and during normal usage are not subject to breakage, substantial freedom is offered in the selection of plate materials. Materials which would be damaged or whose properties might be altered by welding techniques can readily be used in the instant invention.

As noted above, the resilient separators preferably are positioned along the edges of the plates and serve, when compressed, to urge the plate edges against each other to seal the plate edges and reduce or substantially eliminate leakage from one stream to another in a heat transfer operation. A variety of springy materials may be employed, depending upon the temperature and pressure conditions to be encountered in the heat transfer operation. For example, metal mesh of inconel or other alloy, may be employed, or ceramic materials may be employed for higher temperature applications, the ceramic desirably being employed in the form of fibrous strips or boards exhibiting some resiliency. The resilient spacers enable the individual plates to move slightly with respect to one another in their planes, and accordingly allow for small deviations in alignment as the plates are assembled into a plate stack. Although the plates and other plate stack elements desirably are manufactured in accordance with rigid dimensional specifications, the use of resilient separators allows for the use of plates and other elements having somewhat greater dimensional tolerances, the springs absorbing small dimensional variances. Also, the plates as depicted in the drawing can be manufactured from large sheets or rolls of plate material, and standardized dies can be employed to shape the edges of the plates as desired regardless of the plate size.

Except for the relatively small peripheral portions of the plates utilized for mounting the plates one to another, substantially the entire surface of each plate is available for heat transfer, and the size and thinness of the plates may be selected as desired for particular heat transfer applications. Moreover, the heat exchanger plate blocks, complete with frames, may be supplied in standardized sizes, enabling a user to assemble one or more blocks together for particular heat exchange operations. Depending upon the materials chosen, heat transfer at substantially any temperature range may be accomplished.

Because of the internal, springy nature of the plate stacks described herein, the relative position of plates within the plate stack, measured normal to the planes of the plates, is substantially independent of temperature within the selected ranges of use. To protect the edges of the plate stack from erosion due to particles entrained in a stream, elongated protective grids often are mounted to a frame with the grids overlying and protecting the edges of the plates. In the instant invention, since the relative positions of the plates normal to the plate planes are substantially constant relative to the frame, the alignment of the grids with the plate edges similarly remains substantially constant.

INDUSTRIAL APPLICABILITY

The heat exchangers of the invention may be employed in substantially any industrial process in which heat is to be exchanged between two streams. In a typical example, waste heat in the flue gases emitted by a furnace is transferred to combustion air using a heat exchanger of the invention to heat the air, resulting in reduced waste heat loss.

What is claimed is:

1. A heat exchanger plate block providing alternating cross-flow channels for heat exchange between two fluid streams and comprising a stack of consecutive, spaced, parallel, generally rectangular plates mounted within an enclosing frame having generally rectangular end walls parallel to the plates and corner posts extending between and joining corners of the end walls, characterized by including resilient separators between said plates to render the stack of plates resiliently compressible as a unit in a direction normal to the planes of the plates, each separator having an elongated, generally flat, resilient spacer elastically compressible through its thickness and in operative contact with a plate, and a rigid spacer between and in operative contact with the resilient spacer and the next consecutive plate.

2. The plate block of claim 1 wherein the resilient separators space two opposed edges of each plate from adjacent edges of a consecutive plate, and wherein the resilient separators of consecutive plates lie at right angles to each other.

3. The plate block of claim 1 further characterized in that the end walls are pressed against the stack of plates with sufficient force to retain the plate stack in compression sufficient to restrain the plates from gross movement in their planes but enabling the stack to internally absorb growth due to thermal expansion in a direction normal to the planes of the plates.

4. The plate block of claim 1 further characterized by including supportive ribs extending across and between said plates with the ribs on opposite sides of each plate laying at right angles to each other and ribs on the same side of alternating plates being aligned and defining planes normal to the planes of the plates, the defined planes intersecting at right angles and the lines of intersection of the planes extending normal to the planes of the plates, the ribs co-acting with the plates upon severe compression to form structural, supportive columns normal to the planes of the plates and coincident with said lines of intersection to support the plates against warping.

5. The plate block of claim 1 further characterized in that the resilient spacer comprises a mesh of non-woven fibers.

6. The plate block of claim 1 further characterized by including resilient corner spacers spacing corners of the plates from adjacent corner posts to accommodate growth of the plates due to thermal expansion parallel to their planes.

7. The plate block of claim 6 further characterized in that the resilient corner spacers comprise at least one elongated scroll of resilient material extending the normal to the planes of the plates.

8. A heat exchanger plate block providing alternating cross-flow channels for heat exchange between two fluid streams and comprising a stack of consecutive, spaced, parallel, generally rectangular end walls parallel to the plates and corner posts extending between and joining the corners of the end walls, characterized by including:

resilient separators between said plates to render the stack of plates resiliently compressible as a unit in a direction normal to the planes of the plates, each resilient separator comprising a rigid spacer, an elastic means attached thereto, and at least one supportive rib; and resilient corner spacers spacing corners of the plates from adjacent corner posts to accommodate growth of the plates due to thermal expansion parallel to their planes.

9. The plate block of claim 8 wherein the elastic means comprises a leaf spring.

10. The plate block of claim 8 wherein the elastic means comprises an elongated, generally flat, strip-like resilient spacer elastically compressible through its thickness.

11. The plate block of claim 10 wherein the strip-like resilient spacer comprises a mesh of non-woven fibers.

12. A heat exchanger plate block providing alternating cross-flow channels for heat exchange between two fluid streams and comprising a stack of consecutive, spaced, parallel rectangular plates mounted within an enclosing frame having generally rectangular end walls parallel to the plates and corner posts extending between and joining corners of the end walls, characterized by including heat exchanger plates having two opposed edges of which each has a portion extending in one direction normal to the plane of the plate and terminating in a flange extending outwardly parallel to the plane of the plate and the other two opposed edges of the plate each having portions extending in the opposite direction normal to the plane of the plate, each such plate being oriented 90° in its plane with respect to the next consecutive plate with outer edges of the flanges confronting the opposed edge portions extending in said opposite direction of the next consecutive plate, thereby permitting the plates to nest.

13. The plate block of claim 12 including resilient corner spacers spacing corners of the plates from adjacent corner posts to accommodate growth of the plates due to thermal expansion parallel to their planes.

14. The plate block of claim 13 further characterized in that said resilient corner spacers comprise at least one elongated scroll of resilient material, the scroll being positioned between the corner posts and the corners of the plates and extending longitudinally normal to the planes of the plates.

15. The plate block of claim 12 including resilient separators between said plates to render the stack of plates resiliently compressable as a unit in a direction normal to the planes of the plates.

16. The plate block of claim 15 further characterized in that the resilient separators are positioned between adjacent edges of the plates, the separators of consecutive plates lying at right angles to one another, each resilient separator comprising a generally flat, elongated, resilient strip and a rigid spacer oriented in series with respect to one another in a direction normal to the planes of the plates.

17. The plate block of claim 16 further characterized in that the resilient separators are carried in a channel defined by the outwardly extending flange, the portion normal to the plane of the plate, and the adjacent edge of a consecutive plate.

18. A heat exchanger plate block providing alternating cross-flow channels for heat exchange between two fluid streams and comprising a stack of consecutive, spaced, parallel, generally rectangular plates mounted within an enclosing frame having generally rectangular end walls parallel to the plates and corner posts extending between and joining corners of the end walls, characterized by including:

resilient separators between said plates to render the stack of plates resiliently compressible as a unit in a direction normal to the planes of the plates;

resilient corner spacers spacing corners of the plates from adjacent corner posts to accommodate growth of the plates due to thermal expansion parallel to their planes; and corner seals positioned against corners of the plates and urged resiliently by the resilient corner spacers into continuous sealing contact with the plate corners.

19. The plate block of claim 18 further characterized in that the end walls are pressed against the stack of plates with sufficient force to retain the plate stack in compression sufficient to restrain the plates from gross movement in their planes but enabling the stack to internally absorb growth due to thermal expansion in a direction normal to the planes of the plates.

20. The plate block of claim 18 further characterized by including supportive ribs extending across and between said plates with the ribs on opposite sides of each plate lying at right angles to each other and with ribs on the same side of alternating plates being aligned and defining planes normal to the planes of the plates, the defined planes intersecting at right angles and the lines of intersection of the planes extending normal to the planes of the plates, the ribs co-acting with the plates upon severe compression of the latter to form structural, supportive columns normal to the planes of the plates and coincident with said lines of intersection to support the plates against warping.

21. The plate block of claim 18 further characterized in that said resilient corner spacers comprise at least one elongated scroll of resilient material extending normal to the planes of the plates.

22. The plate block of claim 18 further characterized by including consecutive heat exchanger plates each having two opposed edges, each such edge having a portion extending in one direction normal to the plane of the plate and terminating in a flange extending outwardly parallel to the plane of the plate, and the other two opposed edges of the plate each having portions extending in the opposite direction normal to the plane of the plate, each such plate being oriented 90° in its plane with respect to the next consecutive plate with outer edges of the flanges confronting the opposed edge portions extending in said opposite direction of the next consecutive plate, thereby permitting the plates to nest.

23. The plate block of claim 18 further characterized in that the length of the edge portion extending in the opposite direction normal to the plane of the plate and measured parallel to the plane of the plate is substantially less than the overall length of the plate measured in the same direction.

24. The plate block of claim 18 further characterized in that the plates are provided with a plurality of elongated dimples, each dimple arising from the surface of a plate in the same direction relative to the plane of the plates, the dimples formed in consecutive plates being at right angles to each other and the dimples in alternating plates being identically positioned, the dimples in consecutive plates co-acting upon severe compression of the plate stack to form structural, supportive columns extending normal to the planes of the plates and supporting the plates against warping.

25. The plate block of claim 18 further characterized in that each resilient separator includes an elongated, generally flat, resilient spacer elastically compressible through its thickness and in operative contact with an edge portion of a plate, and a rigid spacer between and in operative contact with the resilient spacer and an edge portion of a consecutive plate.

26. The plate block of claim 25 further characterized in that the resilient separators are positioned between adjacent edges of consecutive plates with the resilient separators of consecutive plates lying at right angles to each other.

27. The plate block of claim 25 further characterized in that the elongated resilient spacer comprises a mesh of non-woven fibers.

28. A heat exchanger plate block providing alternating crossflow channels for heat exchange between two fluid streams and comprising a stack of consecutive, spaced, parallel, generally rectangular plates mounted within an enclosing frame having generally rectangular end walls parallel to the plates and corner posts extending between and joining corners of the end walls, characterized by including:

resilient corner spacers spacing corners of the plates from adjacent corner posts to accommodate growth of the plates due to thermal expansion parallel to their planes, the corner spacers each comprising at least one elongated scroll of resilient material extending longitudinally in a direction normal to the planes of the plates;

resilient separators between said plates to render the stack of plates resiliently compressible as a unit in a direction normal to the planes of the plates, each resilient separator comprising a generally flat resilient elongated strip in operative contact with one plate, and a rigid spacer in operative contact with said resilient strip and the opposing plate, the resilient separators of consecutive plates lying at right angles to each other;

the heat exchanger plates each having two opposed edges of which each has a portion extending in one direction normal to the plane of the plate and terminating in a flange extending outwardly parallel to the plane of the plate, and the other two opposed edges of the plate each having edge portions extending in the opposite direction normal to the plane of the plate, each such plate being oriented 90° in its plane with respect to the next consecutive plate with outer edges of the flanges confronting the opposed edge portions extending in said opposite direction of the next consecutive plate, thereby permitting the plates to nest.

29. A heat exchanger plate block providing alternating cross-flow channels for heat exchange between two fluid streams and comprising a stack of consecutive, spaced, generally rectangular parallel plates mounted within an enclosing frame having generally rectangular end walls parallel to the plates and corner posts extending between and joining corners of the end walls, characterized by including:

resilient edge separators spacing two opposed edges of each plate from adjacent edges of a consecutive plate, the resilient edge separators of consecutive plates lying at right angles to each other and enabling the plate stack to be resiliently compressed in a direction normal to the planes of the plates;

resilient corner spacers extending the length of the plate stack measured normal to the planes of the plates and resiliently spacing corners of the plates from adjacent corner posts to accommodate growth of the plates due to thermal expansion parallel to their planes; and corner seals positioned against corners of the plates and urged resiliently by the resilient spacers into continuous sealing contact with the plate corners;

the end walls and corner posts co-acting to compress the plate stack sufficiently to frictionally restrain the plates from gross movement in their planes but allowing for sufficient further compression of the plate stack as a whole to enable the stack to internally absorb growth due to thermal expansion in a direction normal to the planes of the plate.

* * * * *